US005085445A

United States Patent [19]

Boyden

[11] Patent Number: 5,085,445

[45] Date of Patent: Feb. 4, 1992

[54] SKATE CUSHIONING DEVICE

[76] Inventor: Willis G. Boyden, Box 83533, Los Angeles, Calif. 90083

[21] Appl. No.: 667,219

[22] Filed: Mar. 11, 1991

[51] Int. Cl.[5] ..... A63C 1/00

[52] U.S. Cl. ..... 280/11.22; 280/11.28

[58] Field of Search ..... 280/11.19, 11.22, 11.23, 280/11.27, 11.28, 87.041, 87.03, 87.042

[56] References Cited

U.S. PATENT DOCUMENTS

| | | | |
|---|---|---|---|
| 2,126,359 | 8/1938 | Vogt | 280/11.28 |
| 2,552,987 | 5/1951 | Loertz, Jr. | 280/11.28 |
| 2,557,331 | 10/1948 | Wintercorn | 280/11.28 |
| 2,572,133 | 10/1951 | Glenn | 280/11.28 |
| 4,402,521 | 9/1983 | Mongeon | 280/11.28 |

*Primary Examiner*—Andres Kashnikow
*Assistant Examiner*—Richard Camby

[57] ABSTRACT

A roller skate has a compression spring for each of a plurality of rollers for passing over relatively rough terrain. A compression rod having a cylindrical top portion bears against the compression spring in each cylindrical hole placed vertically in the skate body. A middle part of the compression rod has flat sides that define a width that is more narrow than the diameter of the cylindrical portion. The lower part of the compression rod is u-shaped and contains the roller, roller axle, and roller bearings. The upper rod fits comfortable in the vertical hole and is held in the skate body by lateral plates adjacent the flat sides of the middle portion of the compression rods.

1 Claim, 3 Drawing Sheets

SKATE CUSHIONING DEVICE

Modern roller skates have been improved over the standard four wheel variety b y the addition of extra wheels, and other features, to create a smoother, and more comfortable ride. The skater is looking nowadays for a more pleasurable, carefree ride along the boardwalks, as he glides smoothly back and forth in the light breeze of a balmy Sunday afternoon. He is either with his sweetheart, pursuing a mate by demonstrating his skating prowess, getting some beneficial exercise, or simply enjoying a solitary outing. Whatever the reason, the achievement of maximum pleasure and flexibility through a comfortable, effortless glide is primary over the possible extra cost for the skates.

SUMMARY OF THE INVENTION

The object of the skate cushioning device is to create an even smoother ride than is accomplished by today's modern, many-wheeled skates, by the addition of springs to each wheel. This will allow the wheels to conform to the structure of the road much as the modern spring-suspended automobile wheel smooths out the ride, by absorbing the multitude of individual bumps in the springs.

DESCRIPTION OF THE PREFERRED EMBODIMENT

Figure 1:
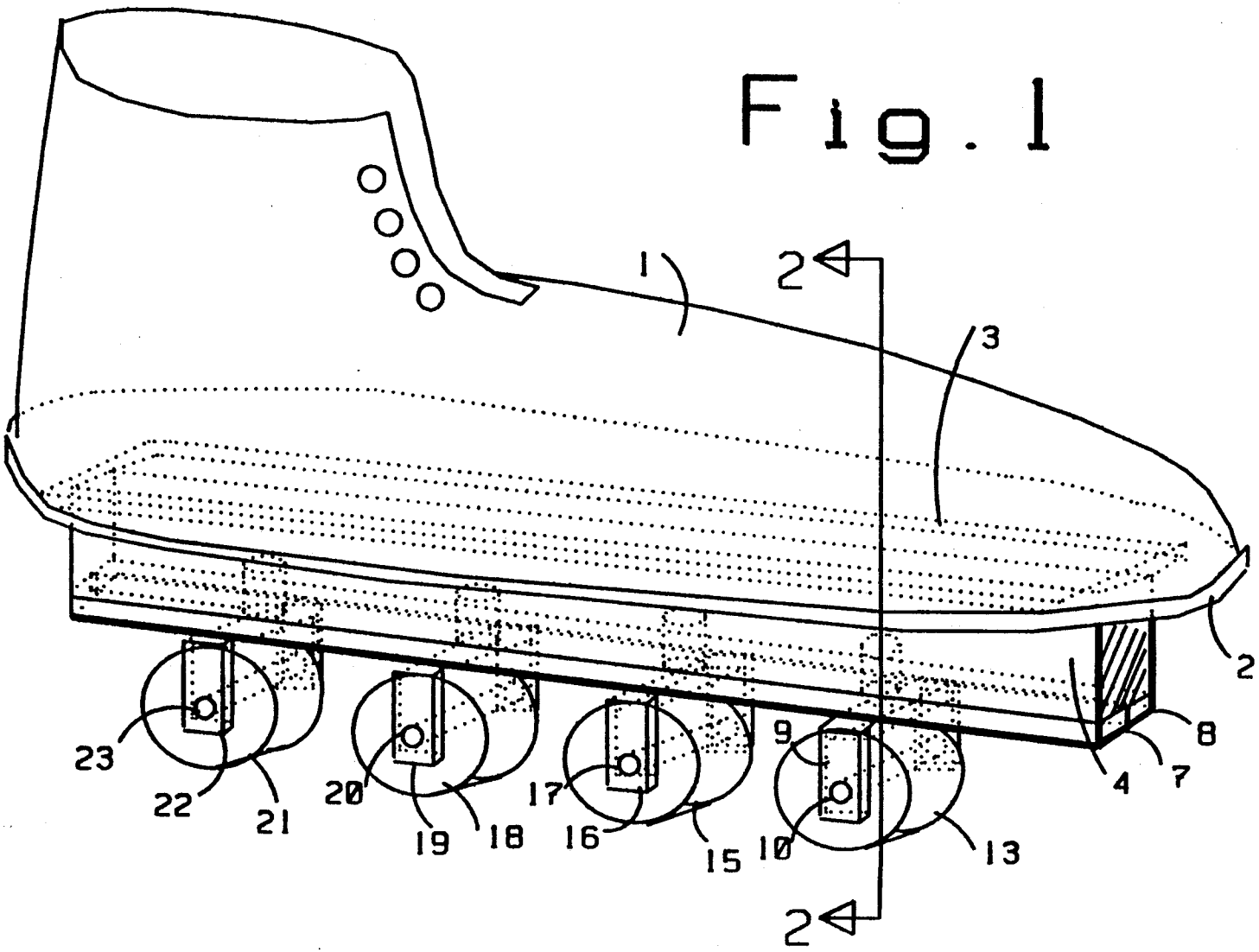
FIG. 1 shows the skating shoe with the roller attached, and skate cushioning device installed.

FIG. 1 shows the preferred embodiment of the skate cushioning device with skate shoe 1 attached to the skate shoe heel 2 and the skate platform 3; the skate platform 3 is attached to the skate body 4. The rollers 13, 15, 18, 21 are attached to the skate body 4 through the axles 10, 17, 20, 23 and the compression rods 9, 16, 19, 22 which act as supports for the rollers 13, 15, 18, 21. Left and right bottom plates 7, 8 run transversely along the bottom of the skate body 4 and are attached to the skate body 4.

Figure 2:
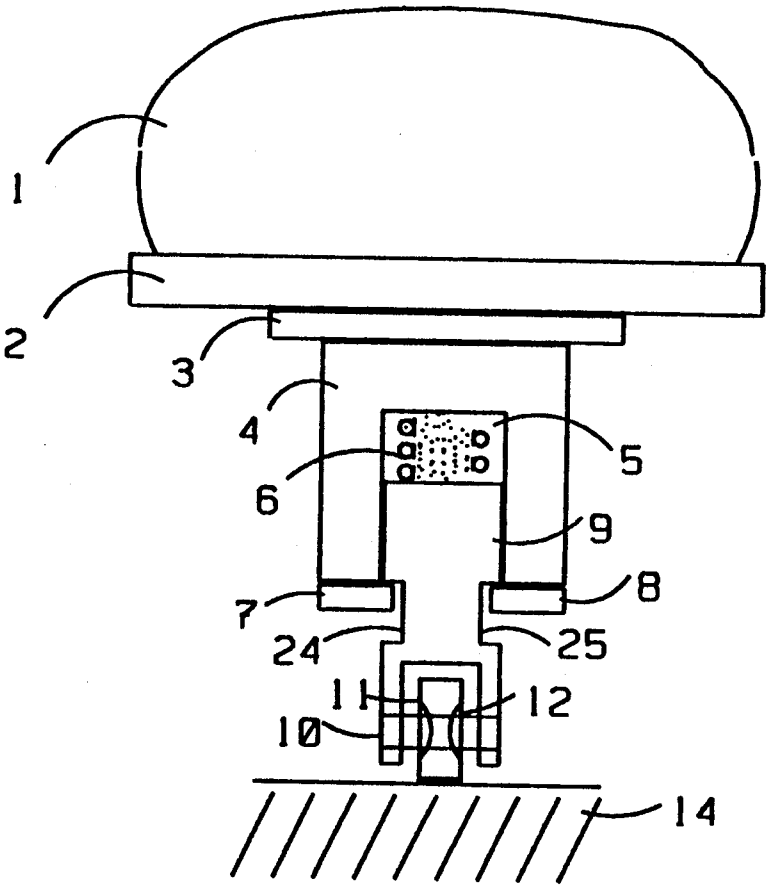
FIG. 2 is a typical cross-sectional view along the plane A of one of the rollers and skate cushioning device.

FIG. 2 is a typical cross-sectional view, along the plane A of one of the rollers 13, 15, 18, 21. The top part of the compression rod 9 is cylindrical, and fits into the cylindrical hole 5 in the skate body 4. The compression spring 6 acts as an energy integrator to smooth and absorb the vertical movements of the compression rod 9. The middle part of the compression rod, the left flat area 24 and right flat area 25, is flat and bears against, and rides between, the left bottom plate 7 and right bottom plate 8. The left bottom plate 7 and right bottom plate 8 keep the wheels straight by bearing against the flat surface areas 24, 25. The lower part of the compression rod 9 is U-shaped and serves to contain the roller 13, axle 10, left bearing 11 and right bearing 12

Figure 3:
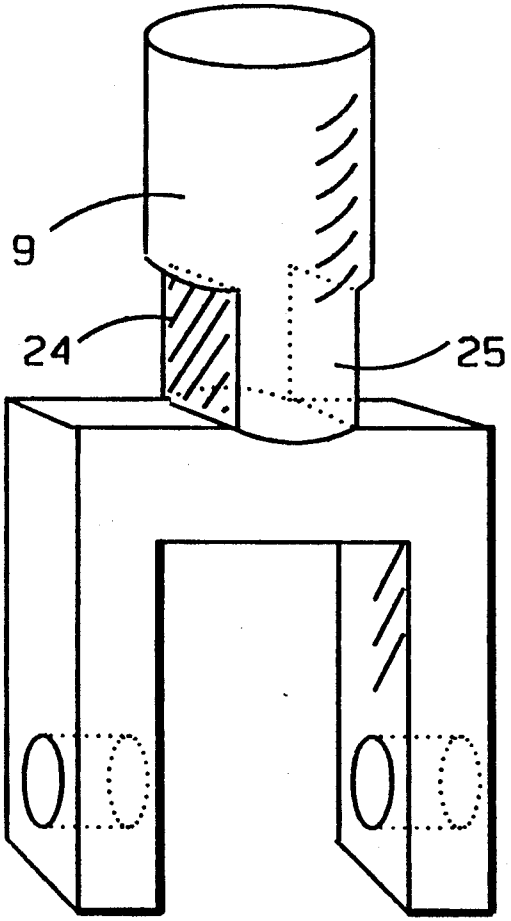
FIG. 3 is a more detailed, stand-alone view of a typical compression rod.

FIG. 3 is a more detailed depiction of the compression rod 9 showing the left flat area 24 and right flat area 25.

I claim:

1. A roller skate cushioning device to be used to cushion the roller skate from skate surface vibration comprising:

a skate shoe, said shoe being attached to a skate heel-sole, said skate heel-sole being attached to one flat side of a skate platform, said skate platform being a strong thin, flat piece rectangular is shape, the long axis of said flat side being contiguous to the long axis of said skate heel-sole, the length of said skate platform being somewhat less than the length of said heel-sole, the width of said skate platform being somewhat less then the width of said heel-sole, a skate body being rectangular in shape, said skate body having a length equal to the length of said skate platform, said skate body having a length equal to the length of said skate platform, said skate body having a width of approximately half the width of said skate platform, said skate body having a depth of about one inch, said skate body being attached to said skate platform, the upper lengthwise side of said skate body being contiguous to the lower flat side of said skate platform, said skate body being centered in the middle of the long axis of said skate platform, a plurality of vertically displaced compression rod holes being inserted in said skate body intersecting the lengthwise central axis of said skate body for about three quarters of an inch, said compression rode holes being equal in number to the rollers compression rods having a top cylindrical portion of radius slightly less than the radius of said compression rod holes, the length of said to portion being approximately equal to one-half inch, a middle portion of said compression rod being about one quarter inch in length and having a flat area on both sides of said middle portion, said middle portion having a width between said flat area on both sides of said middle portion that is less than the diameter of said top cylindrical portion, lower portion of said compression rod being U-shaped with the two days of said U-shaped lower portion extending downward for about one inch, said legs being flat, rectangular pieces, parallel to each other, and approximately one quarter inch apart, the width of said legs being about one-half inch, the cross piece of said U-shaped lower portion being rectangular in shape, said cross piece extending between the top part of said legs, said cross piece being joined, centered with and contiguous with the bottom face of said middle portion, each of said legs having an axle hole for an axle insertion about one quarter of an inch from the bottom of said legs, said axle holes being centered and opposing each other, said compression rods being inserted in said compression rod holes, a compression spring being placed in each of said compression rod holes between the downward-pointing face of said compression hole and the upward-pointing face of said compression rods, a roller axle, roller being inserted in each of said axle holes, a left bottom plate and a right bottom plate comprising two long flat rectangular pieces, to act as stays and positioners, the length of said left and right bottom plates being equal to the length of said skate body, the widths of said left and right bottom plates being equal and somewhat less than half the width of said skate body, said left and right bottom plates attached to the respective left and right bottom sides of said skate body, the inner edges of said left and right bottom plates abutting said flat areas of said middle portion of said compression rods.

* * * * *